US007723593B1

(12) United States Patent
Prentice et al.

(10) Patent No.: US 7,723,593 B1
(45) Date of Patent: May 25, 2010

(54) REVERSABLE DRUM PRACTICE PADS

(76) Inventors: Georgia R. Prentice, 33815 Golden Lantern St., Dana Point, CA (US) 92629; Colin Hilborne, 33815 Golden Lantern St., Dana Point, CA (US) 92629

( * ) Notice: Subject to any disclaimer, the term of this patent is extended or adjusted under 35 U.S.C. 154(b) by 0 days.

(21) Appl. No.: 12/483,121

(22) Filed: Jun. 11, 2009

Related U.S. Application Data

(60) Provisional application No. 61/191,559, filed on Sep. 10, 2008.

(51) Int. Cl.
*G10D 13/02* (2006.01)

(52) U.S. Cl. ..... 84/411 P; 84/411 R; 84/421

(58) Field of Classification Search ..... 84/411 P, 84/411 R, 421
See application file for complete search history.

(56) References Cited

U.S. PATENT DOCUMENTS

| | | | | | |
|---|---|---|---|---|---|
| 1,688,561 | A | * | 10/1928 | Straub | 84/411 R |
| 2,326,305 | A | | 8/1943 | Morarre | |
| 2,475,873 | A | * | 7/1949 | Banta | 84/411 R |
| 2,495,495 | A | * | 1/1950 | Adler | 84/411 R |
| 3,113,480 | A | | 12/1963 | Giarratano | |
| 3,166,970 | A | * | 1/1965 | Ellman | 84/411 R |
| 3,186,290 | A | | 6/1965 | Gould et al. | |
| 3,261,253 | A | * | 7/1966 | Ulano | 84/411 R |
| 3,289,520 | A | | 12/1966 | Simpson | |
| 6,284,959 | B1 | | 9/2001 | Nicolosi | |
| 2006/0021493 | A1 | | 2/2006 | Lewis | |

* cited by examiner

*Primary Examiner*—Jeffrey Donels
*Assistant Examiner*—Robert W Horn
(74) *Attorney, Agent, or Firm*—QuickPatents, Inc.; Kevin Prince

(57) ABSTRACT

This invention is a reversible practice pad for drum practice. The reversible practice pad includes a planar base having at least one sloping base-riser projecting upwardly therefrom. Each base-riser includes a first part of a two-part fastening material affixed to a top surface of each base-riser. A planar platform includes at least one sloping platform-riser projecting downwardly therefrom. Each platform-riser includes a second part of the two-part fastening material affixed to a bottom surface of each platform-riser. The platform includes a cushioning pad fixed to a top surface thereof. The bottom surface of each platform-riser is brought into contact and fastened with the top surface of an associated base-riser. The base and platform can be selectively fixed together in two different orientations by rotating the platform. In one orientation, the platform and the base are substantially parallel. In an alternate orientation, the platform is sloped with respect to the base.

8 Claims, 2 Drawing Sheets

REVERSABLE DRUM PRACTICE PADS

CROSS-REFERENCE TO RELATED APPLICATIONS

This application claims the benefit of US Provisional Patent Application 61/191,559, filed on Sep. 10, 2008, and incorporated herein by reference.

STATEMENT REGARDING FEDERALLY SPONSORED RESEARCH AND DEVELOPMENT

Not Applicable.

FIELD OF THE INVENTION

This invention relates to drum practice pads, and more particularly to a reversible drum practice pad.

DISCUSSION OF RELATED ART

The field of the invention applies to the area of practice devices for students learning to play the drum as well as for musicians warming-up to play the drum. Both young drum students and professional players find that practicing on their drum instrument itself can have two related problems. First, if a student practices on a field drum, i.e., one that is used for a marching band, or a small snare drum used in a dance drum set-up, the sound is a nuisance to the drummer's family or neighbors. Second, playing on the instrument drum itself for extended periods may, and unfortunately has, resulted in significant and permanent hearing loss for the drummer.

The solution of a practice pad to avoid the above problems is not a new invention in itself. For example, U.S. Pat. No. 3,113,480 to Giarratano on Dec. 10, 1963 teaches a drum practice pad. Such devices are made to provide a quiet alternative to drums for practicing drumming skills. However, despite the development of many approaches to practice pads, these approaches often have significant drawbacks.

Drum practice pads need to be quieter than a standard drum, but not too quiet. It is important for drum practice pads to provide a crisp and accurate sound when striking the pad. A practice pad must still provide a realistic feeling and response to improve drumming skills. Therefore, there is a need that for a practice pad that makes drumming practice quieter, yet still provides a realist and useful drumming experience. Thus, some practice pads focus on controlling the sound of the device. For example, U.S. Pat. No. 2,495,495 to Adler on Jan. 24, 1950 teaches a drummer's practice device that can adjust the sound. However, such a solution uses many parts and adds to the cost of the device. Therefore, a device is needed that is relatively quiet yet provides a realistic feeling and accurate drumming sound and is economical for students and teachers.

Drummers also have a need for practice pads with sometimes a sloped surface and sometimes a non-sloped horizontal surface. Marching drummers prefer the horizontal, non-sloping practice pads because it is more like their horizontal, harness-held drum corps or marching drums. The set or dance drummer often prefers a slight slope to the drum practice pad to allow speed of movement between drums and cymbals of different heights within the drum set. The playing surface of some practice pads can be either horizontal or downward sloping. However, some of these approaches teach permanent and unmovable configuration of the practice pads. Therefore, a device is needed that provides both sloped and horizontal orientations so that drummers who practice both methods do not need to buy and carry two different types of practice pads.

Some devices do teach practice pads that offer both horizontal and sloped playing surfaces. For example, the following patents teach variations on this idea: U.S. Pat. No. 2,475,873 to Banta on Jul. 12, 1949 teaches a practice pad that can be propped open; U.S. Pat. No. 3,289,520 to Simpson on Dec. 6, 1966 teaches a practice pad that can be played in a sloped position or horizontal position; and U.S. Pat. No. 3,113,480 to Giarratano on Dec. 10, 1963 teaches a practice drum pad that provides both a sloped practice pad and a horizontal pad next to each other. Though these devices have their advantages, they all add complicated additional features that add to the cost and weight of the device and are unnecessary for basic drum practice. Therefore, a device is needed that can be easily and quickly reversed from a sloped orientation to a horizontal orientation and vice versa, without unnecessary additional features adding to the cost of the device. Furthermore, a device is needed that can be broken down into separate pieces for easier storage and travel.

Therefore, there is a need for a drum practice pad that is relatively quiet yet provides a realistic feeling and accurate drumming sound and is economical for students and teachers. Such a need device should provide both sloped and horizontal orientations so that drummers who practice both methods do not need to buy and carry two different types of practice pads. Also, the needed device would be easily and quickly reversed from a sloped orientation to a horizontal orientation and vice versa, without unnecessary additional features adding to the cost of the device. Further, the needed device could be broken down into separate pieces for easier storage and travel. The present invention accomplishes these objectives.

SUMMARY OF THE INVENTION

The present device is a reversible practice pad for drum practice. The reversible practice pad includes a planar base having at least one sloping base-riser projecting upwardly therefrom. Each base-riser includes a first part of a two-part fastening material affixed to a top surface of each base-riser. A planar platform includes at least one sloping platform-riser projecting downwardly therefrom. Each platform-riser includes a second part of the two-part fastening material affixed to a bottom surface of each platform-riser. The platform includes a cushioning pad fixed to a top surface thereof.

The bottom surface of each platform-riser is brought into contact with the top surface of an associated base-riser, with the two-part fastening material selectively fixing the base to the platform. In one orientation, the platform and the base are substantially parallel. In an alternate orientation, the platform is sloped with respect to the base.

With the base and the platform mutually fixed in the alternate orientation, the platform forms an angle θ with the base of less than 45-degrees. In another embodiment, the platform forms an angle θ with the base of less than 30-degrees. The base further includes a bottom surface having at least three elastomeric feet projecting away therefrom. The at least three elastomeric feet support the reversible practice pad on a surface and act to prevent the practice pad from slipping on the surface.

The present invention is a drum practice pad that is relatively quiet yet provides a realistic feeling and accurate drumming sound and is economical for students and teachers. The device provides both sloped and horizontal orientations so that drummers who practice both methods do not need to buy and carry two different types of practice pads. Also, the device is easily and quickly reversed from a sloped orientation to a horizontal orientation and vice versa, without unnecessary additional features adding to the cost of the device. Further, the reversible practice pad can be broken down into separate pieces for easier storage and travel. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT is Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
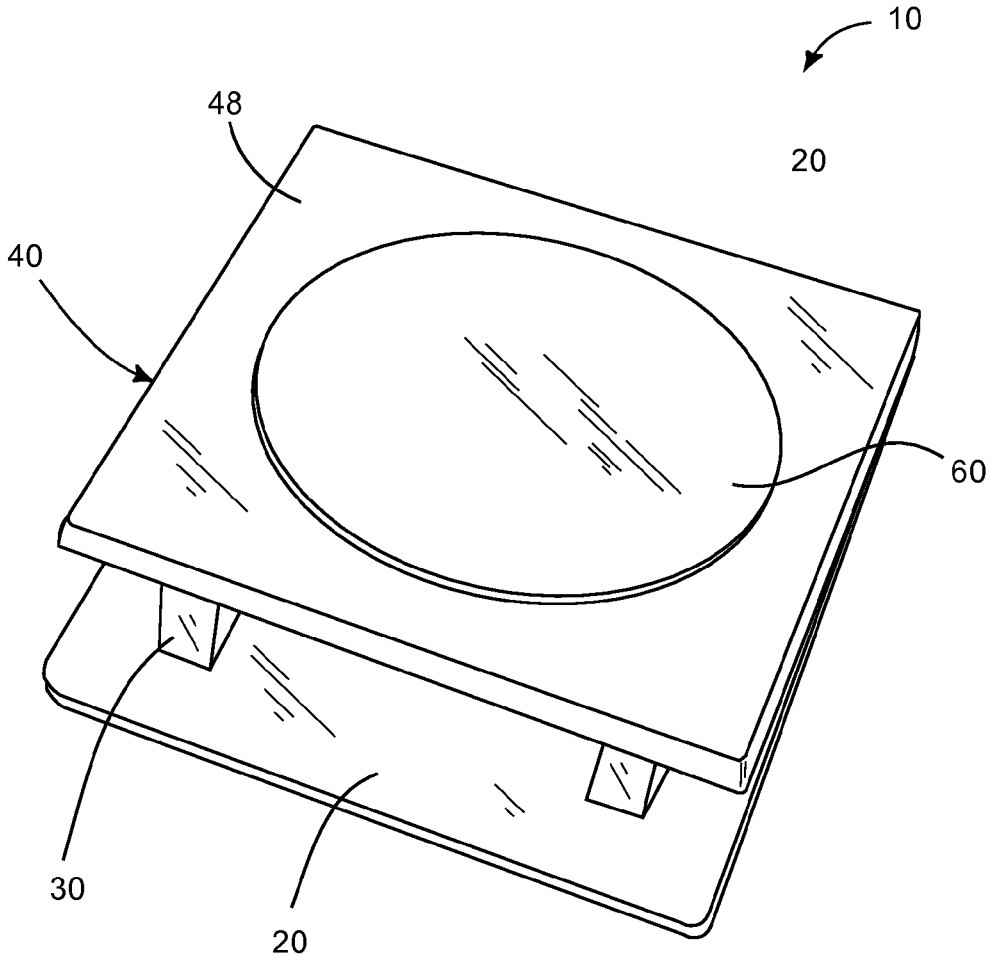
FIG. 1 is a perspective view of a reversible practice pad.
Figure 2:
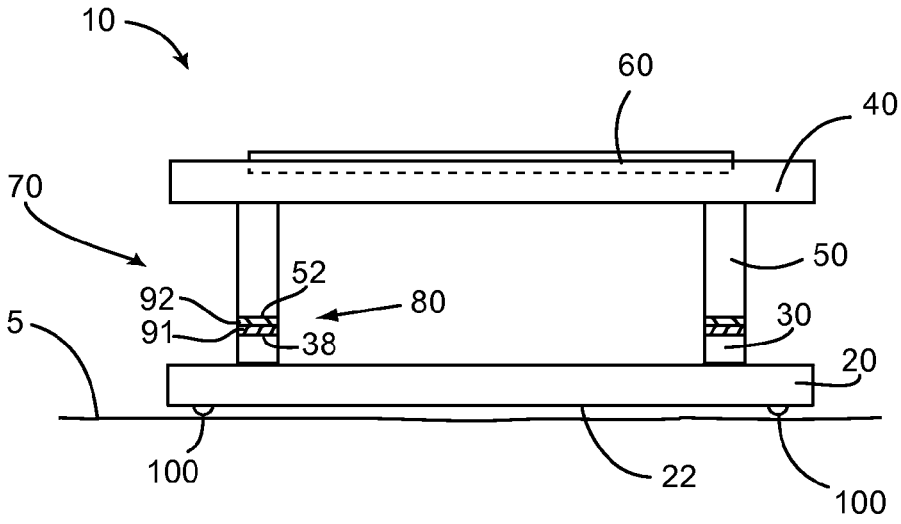
FIG. 2 is a front elevational view of the invention.

With respect to the drawings, FIG. 1 illustrates a reversible practice pad 10 for drum practice. The reversible practice pad 10 includes a planar base 20 having at least one sloping base-riser 30 projecting upwardly therefrom. Each base-riser 30 includes a first part 91 of a two-part fastening material 90 affixed to a top surface 38 of each base-riser 30. In FIG. 2, a planar platform 40 includes at least one sloping platform-riser 50 projecting downwardly therefrom. Each platform-riser 50 includes a second part 92 of the two-part fastening material 90 affixed to a bottom surface 52 of each platform-riser 50. In a preferred embodiment, the two-part fastening material 90 is a hook-and-loop type fastening material (not shown). Other two-part fastening materials 90 may be used, as desired, such as magnets, notches, or snaps.

Figure 3:
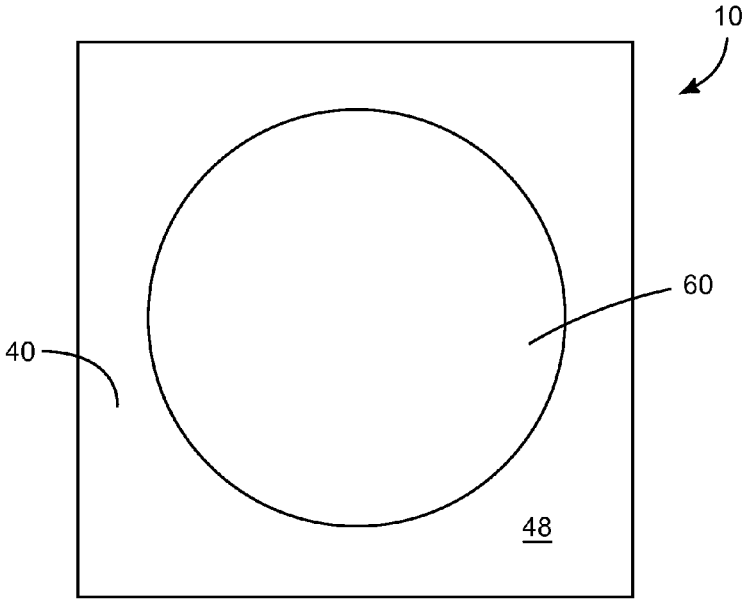
FIG. 3 is a top plan view of the reversible practice pad.

In FIGS. 1 and 3, the platform 40 includes a cushioning pad 60 fixed to a top surface 48 thereof. In a preferred embodiment, in FIG. 2, at least a portion of the top surface 48 of the planar platform 40 is milled out to contain at least a portion of the cushioning pad 60. The cushioning pad 60 is preferably a gum rubber pad, but can also be formed from any suitable cushioning-type material, such as a soft plastic material, if desired. The base 20 and platform 40 are preferably made from a light weight and durable material such as a wood material, but can also be formed from any suitable light and rigid material, such as rigid plastic or light weight metal, if desired. The reversible practice pad 10 provides an inexpensive and relatively quiet drum practice device.

Preferably, the top surface 48 of the platform 40 is milled out with a routing plane (not shown) in the same diameter as the cushioning pad 60. Further, the platform 40 is preferably milled out about ⅛ inch allowing the cushioning pad 60 to settle ⅛ inch into the platform 40. By doing this, the reversible practice pad 10 gives a bright crisp and accurate sound when struck, especially when the preferred material of a gum rubber pad is used for the cushioning pad 60 and the platform 40 is made of a wood material.

Figure 4:
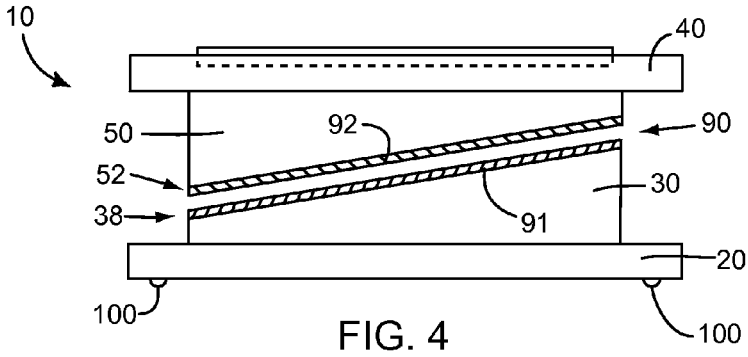
FIG. 4 is a side elevational view of the invention.
Figure 5:
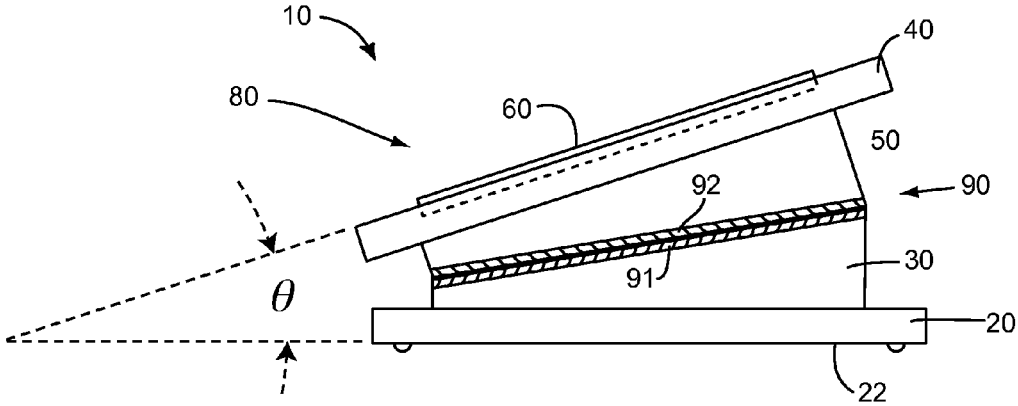
FIG. 5 is a side elevational view of an alternate position of the reversible practice pad.

As illustrated in FIGS. 4 and 5, the bottom surface 52 of each platform-riser 50 is brought into contact with the top surface 38 of an associated base-riser 30, the two-part fastening material 90 selectively fixing the base 20 to the platform 40. In one orientation 70 of the reversible practice pad 10, illustrated in FIG. 4, the platform 40 and the base 20 are substantially parallel. In an alternate orientation 80 of the reversible practice pad 10, as illustrated in FIG. 5, the platform 40 is sloped with respect to the base 20.

In one embodiment, with the base 20 and the platform 40 mutually fixed in the alternate orientation 80, the platform 40 forms an angle θ with the base 20 of less than 45-degrees. In another embodiment, with the base 20 and the platform 40 mutually fixed in the alternate orientation 80, the platform 40 forms an angle θ with the base 20 of less than 30-degrees.

In FIG. 2, the base 20 further includes a bottom surface 22 having at least three elastomeric feet 100 projecting away therefrom. The at least three elastomeric feet 100 support the reversible practice pad 10 on a surface 5 (FIG. 2) and act to prevent the reversible practice pad 10 from slipping on the surface 5. In a preferred embodiment, the platform 40 and the base 20 each have exactly two risers 30,50, as illustrated in FIG. 2.

The reversible drum practice pad 10 allows the angle θ of the cushioning pad 60 to be changed as desired between two orientations 70,80. The ability to change the angle θ of the cushioning pad 60 is made possible by the two-part fastening material 90 and the slope of the risers 30,50. In a preferred embodiment, the platform 40 and base 20 may be pulled apart, rotated horizontally 180° with respect to each other, and fixed together again to place the cushioning pad 60 at a slope to a surface 5 or parallel to a surface 5, as desired. The reversible practice pad 10 may be changed from a horizontal practice device to an angled practice device in seconds. Furthermore, the reversible practice pad 10 can be stored conveniently by separating the base 20 and platform 40.

While a particular form of the invention has been illustrated and described, it will be apparent that various modifications can be made without departing from the spirit and scope of the invention. For example, the cushioning pad 60 could be fixed into the platform 40, such that the cushioning pad 60 lies flush with the top surface 48 of the platform 40. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent is ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A reversible practice pad for drum practice, comprising:

a planar base having at least one sloping base-riser projecting upwardly therefrom, each base-riser having a first part of a two-part fastening material affixed to a top surface of each base-riser; and a planar platform having at least one sloping platform-riser projecting downwardly therefrom, each platform-riser having a second part of the two-part fastening material affixed to a bottom surface of each platform-riser, the platform having a cushioning pad fixed to a top surface thereof;

whereby when the bottom surface of each platform-riser is brought into contact with the top surface of an associated base-riser, in one orientation of the reversible practice pad the platform and the base are substantially parallel, and in an alternate orientation of the reversible practice pad the platform is sloped with respect to the base, the two-part fastening material selectively fixing the base to the platform.

2. The reversible practice pad of claim 1 wherein with the base and the platform mutually fixed in the alternate orientation, the platform forms an angle with the base of less than 45-degrees.

3. The reversible practice pad of claim 1 wherein with the base and the platform mutually fixed in the alternate orientation, the platform forms an angle with the base of less than 30-degrees.

4. The reversible practice pad of claim 1 wherein the base further includes a bottom surface having at least three elastomeric feet projecting away therefrom.

5. The reversible practice pad of claim 1 wherein the platform and the base each have exactly two risers.

6. The reversible practice pad of claim 1 wherein the two-part fastening material is a hook-and-loop type fastening material.

7. The reversible practice pad of claim 1 wherein the cushioning pad is a gum rubber pad.

8. The reversible practice pad of claim 1 wherein the top surface of the planar platform is milled out to contain at least a portion of the cushioning pad.

* * * * *